166-347 SR
7/1/86 OR 4,597,447

United States Patent [19]
Roche et al.

[11] Patent Number: 4,597,447
[45] **Date of Patent: * Jul. 1, 1986**

[54] DIVERTER/BOP SYSTEM AND METHOD FOR A BOTTOM SUPPORTED OFFSHORE DRILLING RIG

[75] Inventors: Joseph R. Roche, Humble; Gabriel G. Alexander, Houston; William L. Carbaugh, Humble, all of Tex.

[73] Assignee: Hydril Company, Los Angeles, Calif.

[ * ] Notice: The portion of the term of this patent subsequent to Jun. 25, 2002 has been disclaimed.

[21] Appl. No.: 609,506

[22] Filed: May 11, 1984

Related U.S. Application Data

[63] Continuation-in-part of Ser. No. 556,626, Nov. 30, 1983, Pat. No. 4,524,832.

[51] Int. Cl.[4] ..... E21B 17/01; E21B 17/07; E21B 33/038; E21B 33/076

[52] U.S. Cl. ..... 166/347; 166/360; 166/367

[58] Field of Search ..... 166/338–345, 166/347, 351, 359, 364, 367, 362, 360; 285/DIG. 22, 330

[56] References Cited

U.S. PATENT DOCUMENTS

| | | | |
|---|---|---|---|
| 2,452,219 | 10/1948 | Bergvall et al. | 285/DIG. 22 |
| 3,032,125 | 5/1962 | Hiser et al. | 166/341 |
| 3,347,567 | 10/1967 | Watkins | 166/341 |
| 3,465,817 | 9/1969 | Vincent | 166/359 |
| 3,647,245 | 3/1972 | Hanes et al. | 166/367 |
| 3,718,350 | 2/1973 | Klein | 285/DIG. 22 |
| 3,791,442 | 2/1974 | Watkins | 166/359 |
| 3,889,747 | 6/1975 | Regan et al. | 166/359 |
| 3,948,547 | 4/1976 | Gache | 285/DIG. 22 |
| 4,138,148 | 2/1979 | Zaremba | 166/340 |
| 4,456,063 | 6/1984 | Roche | 166/84 |

OTHER PUBLICATIONS

Cataloge 822 of Hydril Company, Publ. 1982.
Brochure for KFDJ Platform Diverter System of Hughes Offshore Company, Copyright 1983.

*Primary Examiner*—Stephen J. Novosad
*Assistant Examiner*—Bruce M. Kisliuk
*Attorney, Agent, or Firm*—Dodge, Bush & Moseley

[57] ABSTRACT

A system and method for installing a fluid flow controller and telescoping spools beneath an offshore bottom supported drilling rig rotary table is disclosed. Upper and lower telescoping spools are provided for initially connecting a Diverter/BOP convertible fluid flow controller between structural casing in the well and a permanent housing beneath the drilling rig rotary table.

A system and method for installing a fluid flow controller and a lower telescoping spool beneath and offshore bottom supported drilling rig rotary table is disclosed.

This alternative embodiment of the invention provides the lower telescoping spool connected between the diverter/BOP convertible fluid flow controller and structural casing in the well. The top of the controller is connected to the permanent housing beneath the drilling rig rotary table. Additionally, a diverter system, a low pressure blowout preventer system and a high pressure blowout preventer system are disclosed for both embodiments.

48 Claims, 10 Drawing Figures

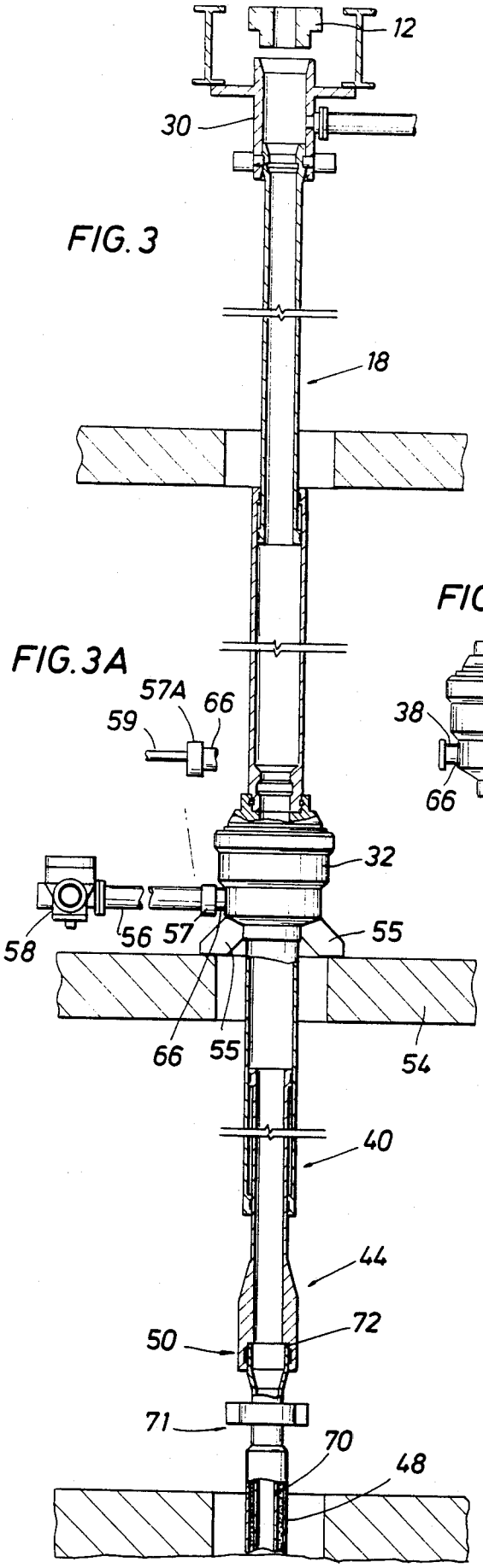
FIG. 3
FIG. 3A
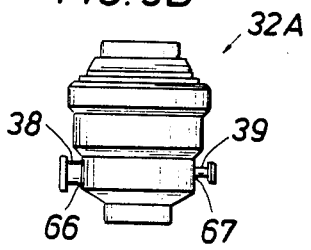
FIG. 3B
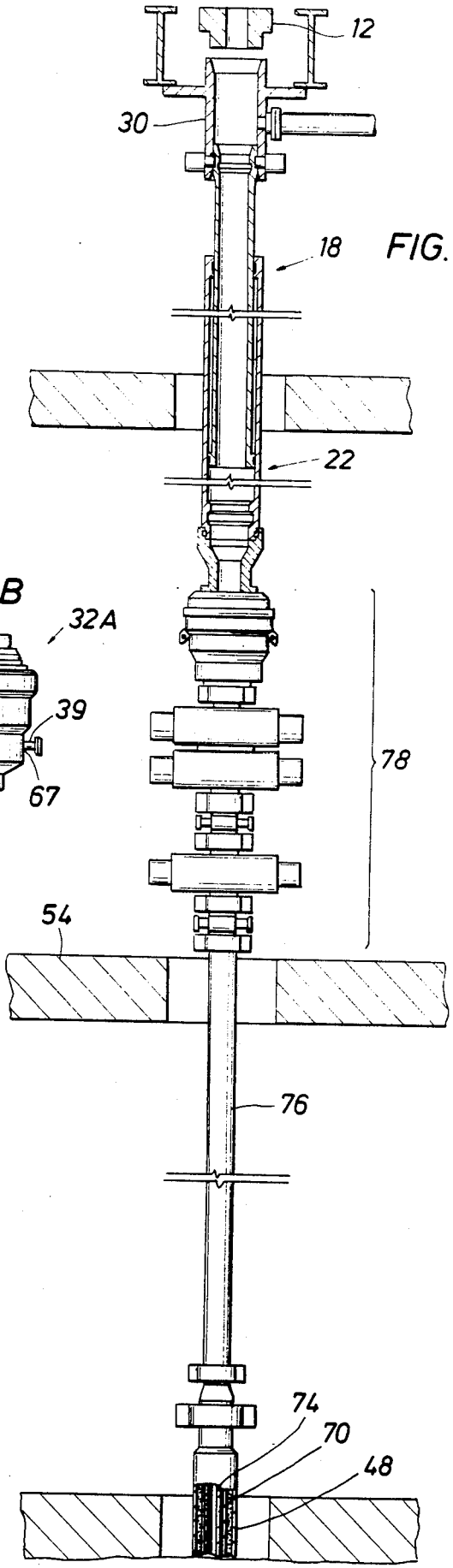
FIG. 4

DIVERTER/BOP SYSTEM AND METHOD FOR A BOTTOM SUPPORTED OFFSHORE DRILLING RIG

CROSS REFERENCE TO A RELATED APPLICATION

This application is a continuation-in-part of U.S. application Ser. No. 556,626, filed on Nov. 30, 1983.

BACKGROUND OF THE INVENTION

1. Field of the Invention

This invention relates in general to diverters and blowout preventer systems for drilling rigs. In particular, the invention relates to diverter and blowout preventer systems and methods for use with bottom supported offshore drilling rigs.

2. Description of the Prior Art

Diverter systems for bottom supported offshore drilling rigs are known in which a diverter element is provided in the support housing attached to the support beams beneath the drilling rig rotary table. Such diverter systems have provided for a vent line and a flow line in the permanent housing beneath the rotary table. Such systems have required external valve systems in the vent line to assure that when the diverter in the permanent housing opens the fluid system to the vent line, the flow may be directed away from the drilling rig. In such prior art systems, a spacer spool has been typically provided beneath the support housing and a thirty (30) inch overshot connection has been provided between the spacer spool and the thirty (30) inch outside diameter drive pipe or structural casing.

Fatal and costly accidents have resulted from the complexity of prior art diverter systems described above. Typical prior art diverter systems have included an annulus closing device, external vent and flow line valves, actuators, limit switches and sequenced controls. This complicated valving and piping of the prior art has been further complicated by the inherent risks of manipulating loose packer inserts into the diverter itself. The complexity of the prior art systems has invited a variety of human error and equipment malfunctions.

One problem with the prior art systems has involved the use of external valving in the diverter system. Valves which are external to the diverter unit not only add clutter to the diverter system and the rig configuration, but also require multiple control functions which are required to operate properly. For example, the prior art diverter system valves have required an actuating pressure signal that is regulated to a discrete pressure level different from the operating pressure level of the diverter unit. The need for separate and different control functions executed in only one safe sequence has required separate pressure regulators and connecting components that are in different locations on the underside of the rig floor. Such a requirement has invited mistakes and malfunctions.

In addition to the problem of multiple control functions, there has existed problems with crossed connections in prior art diverter systems. Misconnection of control lines can cause a valve to be closed when it should be open which could result in an explosion in the diverter or breach of the casing.

Another problem of the prior art diverter systems has been exposure of delicate parts such as hydraulic tubing and fittings, limit switches, mechanical linkages and valve actuators to the rig work area. Such exposure has in the past caused breakage and damage to such parts. System malfunctions which result from damage to exposure can be catastrophic.

Another problem of prior art diverter systems has been the result of vent line blockage. Because the vent valve has been remote from the diverter unit itself, a stagnant space has existed at a critical location in the vent line. Buildup of solids and caking of mud in such a dead space may cause the critically important vent line to be choked off. A restricted or shut-off vent line may cause a dangerous pressure increase while being called upon to divert.

Still another problem of prior art diverter systems has involved the use of component sources from a number of different manufacturers. The annulus closing device, vent and flow line valves, actuators, sequencing devices and control system components have typically been provided by different manufacturers. Rig operating personnel are usually burdened with devising the vent line valve circuit interconnecting the components (which are often widely physically separated when installed) and stocking a varied assortment of spare parts using extraordinary caution to avoid misconnections and keeping a number of rig personnel trained to operate and maintain a diverse assortment of complicated components.

Still another problem of prior art diverter systems for bottom supported rigs has been the requirement of a high pressure valve in the vent line. Closure of such a valve has enabled the diverter unit to be converted to a blowout preventer after sufficient casing pressure integrity has been established. However, if this valve should inadvertently be closed during an attempt to divert, breach of the casing or explosion of the diverter system could threaten the safety of the rig itself.

Still another problem of prior art diverter systems has been the result of valve mismatch. While many different types of valves have been used in diverter systems, there has been no single valve that is especially well suited to the particular application of a diverter system. Selection of the type, size and rating of such valves has been a vexing puzzle for designers of rig valve systems which has been required to be solved usually when a new drilling rig is being built.

Another important disadvantage of the prior art diverter systems has been the necessity to stop drilling operations and manipulate packer inserts to facilitate annulus shut-off. Such a necessity has not only been a time consuming task, it has presented very real hazards. One such hazard has been the problem of forgotten inserts. Often in the course of determined efforts to drill ahead, fetching, installing and latching the packer insert is overlooked. Without such an insert there is no diverter protection. If the insert is in place, but not latched down in some prior art diverter systems, the packer insert is potentially a dangerous projectile.

A second problem resulting from the use of packer inserts has been the problem of an open hole hazard. There has been no protection from the insert type diverter against uncontrolled well fluid flows. Such lack of protection has left a serious safety gap in the drilling operation.

Still another problem of the use of packer inserts in the prior art diverter systems has been the problem of forgotten removal. If unlatch and removal of the packer insert has been inadvertently overlooked before pulling drill pipe from the hole, centralizers or the bottom hole assembly may be run into the insert, thereby endangering the drilling crew and equipment.

Still another problem of the use of packer inserts in the prior art drilling systems has been the problem of exploding packers. If during testing, the standard packer is not reinforced by an insert and/or a pipe in the hole, the hydraulic fluid pressure may cause the packer to explode, thus jeopardizing the safety of the crew.

Perhaps the most important problem of the prior art diverter systems has been the inherent risk of pressure testing in-situ. Pressure testing of prior art diverter systems has been accomplished by overriding the safety sequencing in the valves so that the vent line valve is closed simultaneously with closure of the annulus. Disastrous results have been experienced when the safety overriding mechanism has been unintentionally left in place when testing was complete and drilling was resumed.

IDENTIFICATION OF OBJECTS OF THE INVENTION

It is therefore a primary objective of this invention to overcome the disadvantages and problems and inherent safety risks of the prior art diverter systems.

It is another object of the invention to provide a diverter system for a bottom founded offshore drilling rig in which the vent line is always open. In other words, it is an object of the invention to provide a system having no valves or other obstructions in the vent line, thereby avoiding the complexity of external valves, valve actuators and valve control functions.

It is a further object of the invention to provide a blast selector/deflector permitting manual preselection of port or starboard venting using a hardened target plug that permits vent flow even during position change.

It is still another object of the invention to provide a single control function for operation of the diverter system. In other words, it is an object to provide on command, a single signal to one component for performing an inherently safe execution of the rerouting of flow of a well kick.

It is another object of the invention to provide a rugged and protected system, one which needs no external valves, linkages, limit switches, interconnecting control lines, etc. which may be subject to the breakage of critical parts.

It is another object of the invention to provide a system having no stagnant space, a system in which the vent flow is immediately opened when the diverter system begins to divert fluid away from the well. Avoiding the stagnant space in the system, prohibits caking of solids that may obstruct or shut-off vent flow.

It is still another object of the invention to provide an annular packing unit in a diverter system thereby affording many important safety and operational advantages such as the avoidance of providing inserts when running in and pulling out of the hole during the drilling operations. Potentially fatal mistakes of forgetting to fetch, install, remove and latch down inserts are avoided. Such advantages also include the effect of rig time saved.

Another important advantage of the diverter system according to the invention is to provide a diverter system packing unit which can close on open bore thus providing ready assurance of safety in the event of excessive well flow while there is no pipe in the hole and thereby eliminating a serious gap in the safety of the drilling operation of prior art diverter systems.

Another important advantage of the invention is to provide for safe testing with a packing unit which does not directly contact hydraulic fluid during actuation, thereby eliminating the dangers of exploding packers.

It is another object according to one embodiment of the invention to provide telescoping spools above and below the diverter blowout preventer unit providing a system which is versatile and time efficient.

It is another object of the invention to provide telescoping spools between the diverter and blowout preventer system which have high strength quick-connect couplings permitting reliable, fast nippling up and down.

It is another object according to an alternative embodiment of the invention to provide a telescoping spool below the diverter/blowout preventer unit and fastening the diverter/blowout preventer unit to the bell nipple or permanent housing providing a system which is versatile and time efficient.

It is another object of the invention to provide a telescoping spool between the diverter and the blowout preventer system which has high strength quick, connect couplings permitting reliable, fast nippling up and down.

SUMMARY OF THE INVENTION

The above identified objects of the invention as well as other advantages and features of the invention flow from a novel system adapted for alternative use as a diverter or a blowout preventer for a bottom supported drilling rig. The system is adapted for connection to a bell nipple or permanent housing attached to rig structure members beneath the drilling rig rotary table. The permanent housing has an outlet connectable to the rig fluid system flow line.

The system according to the invention includes a fluid flow controller (e.g., diverter/blowout preventer) having a housing with a lower cylindrical opening and an upper cylindrical opening and a vertical flow path therebetween and a first outlet passage provided in the housing wall. An annular packing element is disposed within the housing. An annular piston means adapted for moving from a first position to a second position is provided whereby in the first position the piston means wall prevents interior fluid from communicating with the outlet passage in the housing wall and in the second position, the piston means wall allows fluid communication of interior fluid with the outlet passage and urges the annular packing element to close about an object extending through the bore of the housing or to close the vertical flow path through the housing in the absence of an object in the vertical flow path. Means are provided in the system for connecting alternatively a blind flange, a vent line or choke/kill line to the first outlet passage provided in the housing wall.

A lower telescoping spool having a lower connector means at its lower end is provided for joining to structural casing or to a mandrel connected to a conductor string cemented within the structural casing. An upper connection means on the upper part of the lower telescoping spool is provided for connection to the lower cylindrical opening of the fluid flow controller. An upper telescoping spool having a lower connection means for connection to the upper cylindrical opening of the fluid flow controller is also provided.

Advantageously, the lower joining means at the lower end of the lower telescoping spool is an overshot connection. The upper connection means at the upper end of the lower telescoping spool is preferably a snap joint connector. The lower connection means of the upper telescoping spool is likewise preferably a snap joint connector. Hydraulic latch means provided on the permanent housing connect the upper part of the upper telescoping spool to the permanent housing. The means for alternatively connecting a vent line, a blind flange or a choke/kill line to the first outlet passage in the controller housing wall comprises a spool extending from the outlet passage and a clamp or flange fastening means for connecting the spool to alternatively the vent line, a choke/kill line or a blind hub or flange.

A second outlet passage in the housing wall of the controller is provided with means for alternatively connecting a choke/kill line or a blind flange to the second outlet passage. The first outlet passage in the preferred embodiment comprises a twelve (12) inch spool and the second outlet passage in the preferred embodiment comprises a four (4) inch spool extending from their respective outlet passages.

Also, according to the invention, a method is provided for installing a system adapted for alternative use as a diverter or as a blowout preventer for a bottom supported drilling rig beneath the permanent housing attached to rig structure members supporting the drilling rig rotary table after structural casing has been set in a borehole. The method comprises the steps of lowering through the rotary table a collapsed and pinned lower telescoping spool having a lower joining means at its lower end and an upper connector means at its upper end. The lower joining means is joined at the lower end of the lower spool to the structural casing in the borehole.

A fluid flow controller having a first housing wall outlet and adapted for alternative use as a diverter or blowout preventer is moved to a drilling rig subsupport structure beneath the rotary table. The controller is fastened to the subsupport structure after the controller is substantially aligned with the bore of the rotary table above and the lower telescoping spool below. The lower telescoping spool is unpinned and stroked out until the connector means at its upper end connects with the lower end of the controller. A collapsed and pinned upper telescoping spool is lowered through the rotary table. The upper telescoping spool has a lower connector means at its lower end which is connected to the upper end of the controller by means of its lower connector means. Next, the upper telescoping spool is unpinned and stroked out until the upper end of the upper telescoping spool connects with the permanent housing.

A vent line connection to the wall outlet of the controller housing results in a completed system which may be used as a diverter system for drilling the borehole for the conductor string through the structural casing.

After the well has been drilled for a conductor string and after the conductor string has been cemented in the well, the method, according to the invention, further includes lifting the lower barrel of the lower telescoping spool, cutting off the conductor string, attaching a mandrel having the same outer diameter as that of the structural casing to the top of the conductor string, and lowering the lower barrel of the lower telescoping spool until the lower joining means of the lower spool joins with the mandrel.

The system which results from the above steps may be used as a diverter during drilling through the conductor string. The method described above may further comprise the steps of removing the clamped or flanged vent line connection at the wall outlet of the controller housing, installing a reducer hub or flange to a choke/kill line, and making up the reducer hub or flange to the wall outlet of the controller housing. The system which results from the above series of steps may be used as a blowout preventer during drilling through the conductor string.

The method according to the invention further includes steps after a smaller diameter casing has been cemented into the well. These steps comprise disconnecting the upper telescoping spool from between the flow connector in the permanent housing, collapsing and pinning the upper telescoping spool and removing the upper telescoping spool through the rotary table, disconnecting the flow controller from the lower telescoping spool and removing the flow controller to a stowed position beneath the rig floor, collapsing and pinning the lower telescoping spool from the mandrel and removing the lower spool through the rotary table, connecting a high pressure blowout preventer spool through the rotary table to the smaller diameter casing, installing a high pressure blowout preventer stack in position above the high pressure spool, and lowering the upper telescoping spool through the rotary table for connection between the high pressure blowout preventer stack and the permanent housing.

The controller further comprises a second wall outlet having a blind flange connected to the second wall outlet so as to prevent flow therethrough. The blind flange can be removed and alternatively a choke/kill line connected to the second wall outlet when a blind flange is connected to the first wall outlet.

According to an alternative embodiment of the invention, the system includes a fluid flow controller having a housing with a lower cylindrical opening and an upper cylindrical opening and a vertical flow path therebetween in a first outlet passage provided in the housing wall. An annular packing element is disposed within the housing. An annular piston means adapted for moving from a first position to a second position is provided whereby in the first position the piston means wall prevents interior fluid from communicating with the outlet passage in the housing wall and in the second position, the piston means wall allows fluid communication of interior fluid with the outlet passage and urges the annular packing element to close about an object extending through the bore of the housing or to close the vertical flow path through the housing in the absence of an object in the vertical flow path. Means are provided in the system for connecting alternatively a vent line, a choke/kill line or a blind flange to the first outlet passage provided in the housing wall.

A lower telescoping spool having a lower joining means at its lower end is provided for joining alternatively to a structural casing or a mandrel connected to a conductor string cemented within the structural casing. An upper connection means on the upper part of the lower telescoping spool is provided for connection to the lower cylindrical opening of the fluid flow controller. The permanent housing provides a lower connection means for connection to the upper cylindrical opening of the fluid flow controller.

Advantageously according to the alternative embodiment of the invention, the lower joining means at the lower end of the lower telescoping spool is an overshot connector. The upper connection means at the upper end of the lower telescoping spool is a snap joint connector. The lower connection means of the permanent housing is a hydraulic latch means for connecting the upper cylindrical opening of the fluid flow controller to the permanent housing. The means for alternatively connecting a vent line, a choke/kill line or a blind flange to the first outlet passage in the controller housing wall comprises a spool extending from the first outlet passage and a clamp or flange fastening means for connecting the spool alternatively to the vent line, the blind clamp or flange or to the choke/kill line.

A second outlet passage is provided in the controller housing wall having a four (4) inch spool, in the preferred embodiment, extending from the second outlet passage and means for alternatively connecting a choke/kill line or a blind flange to the spool extending from the second outlet passage.

Also, according to the alternative embodiment of the invention, a method is provided for installing a system adapted for alternative use as a diverter or as a blowout preventer for a bottom supported drilling rig beneath the permanent housing attached to rig structure member supporting the drilling rig rotary table after structural casing has been set in a borehole. The method comprises the steps of lowering through the rotary table a collapsed and pinned lower telescoping spool having a lower joining means at its lower end and an upper connection means at its upper end. The lower joining means at the lower end of the lower spool is joined to the structural casing in the borehole.

A fluid flow controller having a first housing wall outlet spool and adapted for alternative use as a diverter or blowout preventer is moved to a drilling rig subsupport structure beneath the rotary table so that the rotary table is located above the controller and the lower telescoping spool is located below the controller. A handling or running tool is used to raise the fluid flow controller until an upper end of the controller connects with the permanent housing. The lower telescoping spool is unpinned and stroked out until the connection means at its upper end connects with the lower end of the controller. A vent line connection to the first wall outlet spool of the controller housing results in a completed system which may be used as a diverter system for drilling the borehole for the conductor string through the structural casing.

After the well has been drilled for a conductor string and after the conductor string has been cemented in the well, the method according to the alternative embodiment of the invention, further includes lifting the lower barrel of the lower telescoping spool, cutting off the conductor string, attaching an upwardly facing mandrel having the same nominal diameter as that of the structural casing to the top of the conductor string, and lowering the lower barrel of the lower telescoping spool until the lower joining means of the lower spool joins with the mandrel.

The method according to the alternative embodiment of the invention further includes steps after a smaller diameter casing has been cemented into the well. The steps comprise disconnecting the clamped or flanged vent line connection to the wall outlet spool of the controller housing, disconnecting the fluid flow controller from the lower telescoping spool and removing the flow controller to a stowed position beneath the rig floor, installing a blind hub or flange to the wall outlet spool, collapsing and pinning the lower telescoping spool and removing the lower spool through the rotary table, installing a low pressure spacer spool having an overshot sub at its lower end to the mandrel, installing a low pressure blowout preventer stack to the low pressure spacer spool, installing either a second telescoping or hard spool through the rotary table above the low pressure blowout preventer stack, and connecting the second spool to the permanent housing. The blind hub or flange in the steps above for the low pressure blowout preventer system could be removed and a choke/kill line could be installed to the first wall outlet spool.

The system which results from the above series of steps may be used as a low pressure blowout preventer during drilling through the conductor string.

The method according to the alternative embodiment of the invention further includes steps after a smaller diameter casing has been cemented into the well. These steps comprise disconnecting the fluid flow controller from the lower telescoping spool and the permanent housing and removing the flow controller to a stowed position beneath the rig floor, collapsing and pinning the lower telescoping spool from the mandrel and removing the lower spool through the rotary table, connecting a high pressure blowout preventer spacer spool to the smaller diameter casing, installing a high pressure blowout preventer stack above the high pressure blowout preventer spacer spool, connecting a second spool to the top of the high pressure blowout preventer stack, and connecting the second spool to the permanent housing, whereby a high pressure blowout preventer system is presented.

The second spool may be either a telescoping or hard spool and the blind flange may be removed from the wall outlet spool and a choke/kill line installed thereon.

BRIEF DESCRIPTION OF THE DRAWINGS

The objects, advantages and features of the invention will become more apparent by reference to the drawings which are appended hereto and wherein like numerals indicate like parts and an illustrative embodiment of the invention is shown of which:

FIG. 3 illustrates the invention after a conductor casing has been provided within the structural casing and a mandrel atop an adapter spool has been connected to the conductor casing and the lower part of one lower telescoping spool has been connected thereto.

FIG. 3A further illustrates the alternative connection of the choke/kill line to the spool in the flow controller wall.

FIG. 3B illustrates an alternative controller having a first and second outlet passage;

FIG. 4 illustrates the invention after the casing string has been cemented within the conductor casing and after the lower telescoping spool and fluid flow controller have been removed and replaced by a high pressure blowout preventer stack, a high pressure spool and after the upper telescoping spool has been returned to the top of the blowout preventer stack via the rotary table bore;

DESCRIPTION OF THE INVENTION

Figure 1:
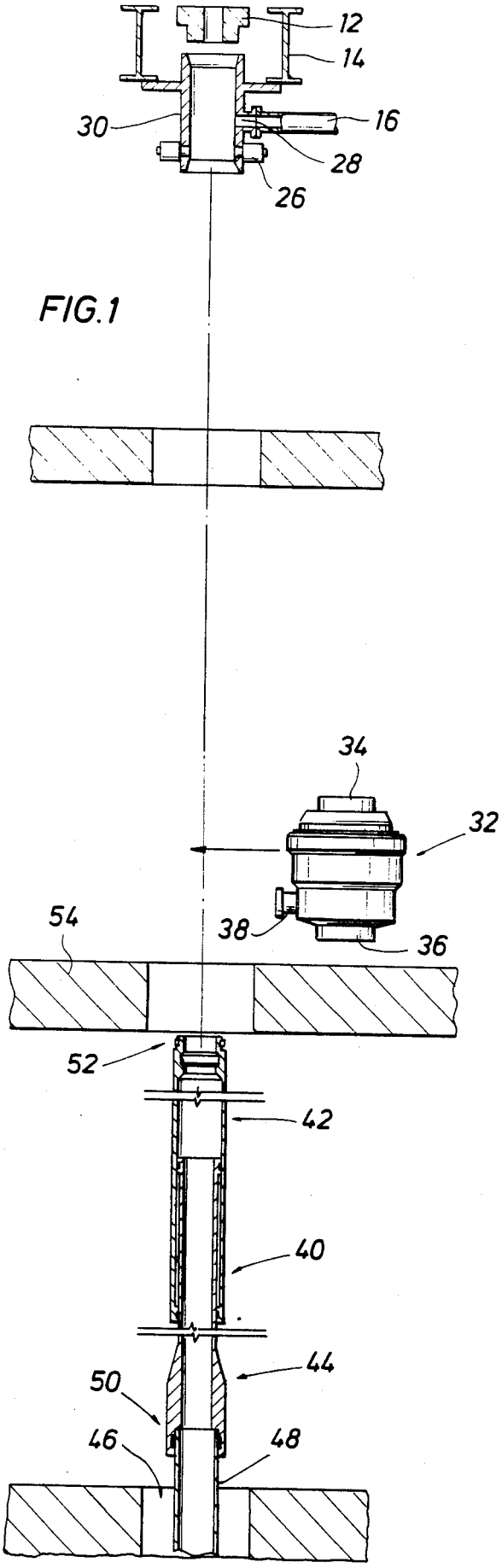
FIG. 1 illustrates the providing of the fluid flow controller and system according to the invention at a structural level beneath the drilling rig rotary table and further illustrating upper and lower telescoping spools being provided through the bore of the rotary table for connection to the fluid flow controller and to the structural casing in the borehole.

FIG. 1 illustrates the apparatus and method for installing a diverter/BOP system between the bell nipple or permanent housing 30 attached to support beams 14 beneath the drilling rig floor. Rotary table 12 has a bore which may be opened to coincide with that of the permanent housing thereby allowing tubular members to be inserted through the bore of the rotary table 12 and the permanent housing 30 to positions below. Permanent housing 30 has a flow line 16 connected to an opening in its wall. A fill up line (not illustrated) may be similarly connected to another hole in the wall.

Figure 2:
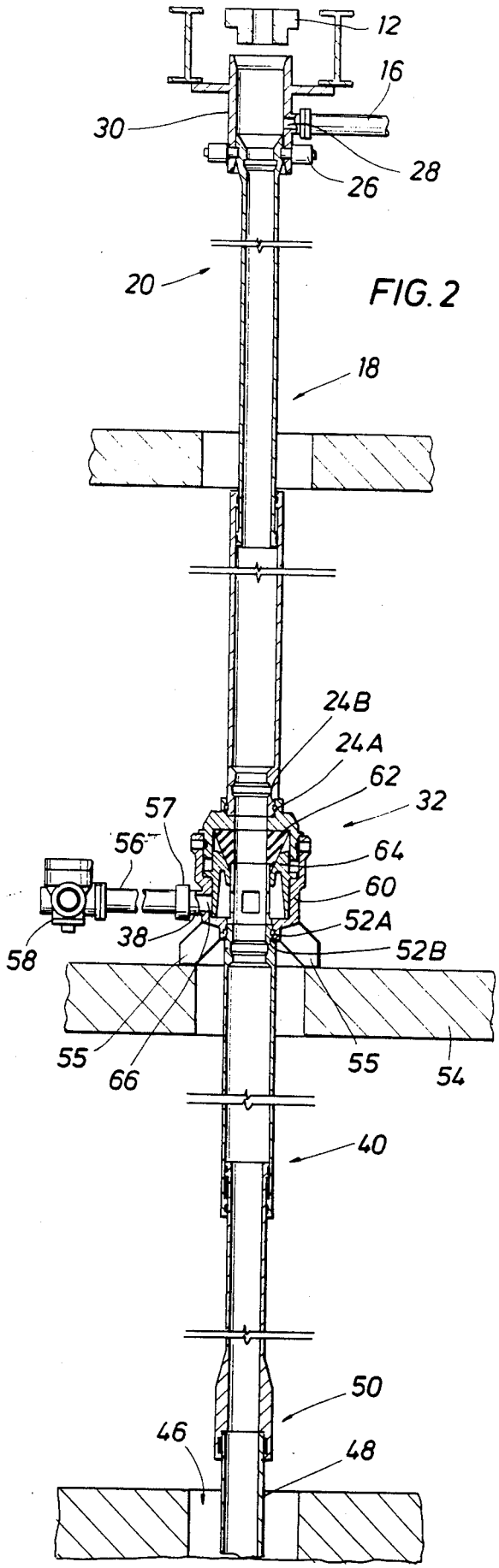
FIG. 2 shows the system according to the invention in which the upper telescoping spool and lower telescoping spool have been connected to the fluid flow controller and further illustrating a vent line connected to an opening in the housing walls of the fluid flow controller.

At the heart of the system and method, according to the invention, is a fluid flow controller 32 having an upper cylindrical opening 34 and a lower cylindrical opening 36 and a spool 38 connected to a first outlet passage 66 in the housing wall. The cross-section of the flow controller 32 is illustrated in FIG. 2. The fluid flow controller, according to the invention, is described in detail in U.S. patent application Ser. No. 449,531 assigned to the same assignee as this application is assigned. Such application is incorporated herewith for all purposes.

Briefly, the fluid flow controller includes a housing 60 with a lower cylindrical opening 36 and an upper cylindrical opening 34 and a vertical flow path therebetween. A first outlet passage 66 is provided in its wall and communicates with the spool 38. An annular packing element 62 is provided within the housing and an annular piston means 64 is adapted for moving from the first position to a second position. In the first position, the piston means wall prevents interior fluid from communicating with the outlet passage 66 in the housing wall. In the second position, the piston means wall allows fluid communication of interior fluid with the outlet passage 66 and urges the annular packing element 62 to close about an object extending through the bore of the housing such as a drill pipe or to close the vertical flow path through the housing in the absence of any object in the vertical flow path.

Returning now to FIG. 1, the fluid flow controller 32 is disposed and stored in the drilling rig in a sublevel illustrated by support memher 54. After the initial opening in the sea floor has been provided such as illustrated by borehole 46, a structural casing 48 is provided therein typically having a thirty (30) inch outside diameter. A lower telescoping spool 40 is lowered through the bore of the rotary table 12 through the permanent housing 30 to the proximity of the structural casing 48. A handling tool (not illustrated) lowers the lower telescoping spool until the overshot connection 50 at the lower part of the lower telescoping spool 44 engages the outer diameter of the structural casing 48 providing an overshot connection to it.

Preferably, during this stage of the joining of the lower telescoping spool 40 to the structural casing 48, the lower telescoping spool 40 is collapsed and pinned so that the upper part of the lower telescoping spool is not free to move with respect to the lower part 44 of the lower telescoping spool. Next, the fluid flow controller 32 is moved horizontally into position above the lower telescoping spool 40 and beneath the vertical bore of the permanent housing 30 and the rotary table 12. An upper telescoping spool 18, as illustrated in FIG. 2, is also lowered through the bore of permanent housing 30 and rotary table 12.

A snap ring connector 52 at the top of the upper part 42 of the lower telescoping spool and the snap ring connector 24A at the lower part 22 of the upper telescoping spool 18 provide means for connecting the lower telescoping spool 40 and the upper telescoping spool respectively to the lower cylindrical opening 36 and the upper cylindrical opening 34 of the fluid flow controller 32. The upper part of the lower telescoping spool is then stroked out until the snap ring connector 52 fits within the lower cylindrical opening 36 and the snap ring 52A, illustrated in FIG. 2, snaps over an annular shoulder 52B in the lower cylindrical opening 36 thereby connecting the lower telescoping spool 40 to the fluid flow controller 32.

Next, the snap ring connector 24A of the upper telescoping spool is lowered until it fits within the upper cylindrical opening 34 of the fluid flow controller 32 and snap ring connector 24A snaps past a shoulder 24B in the upper cylindrical opening 34 providing connection between the upper telescoping spool and the fluid flow controller.

As illustrated in FIG. 2, the upper telescoping spool is then stroked out until the upper part 20 of the upper telescoping spool 18 fits withthin the permanent housing 30 and the latching means 26 may engage the outer surface of the upper part 20 of the upper telescoping spool 18 thereby connecting it to the permanent housing 30. Thus, in normal operation as illustrated in FIG. 2, the fluid returning from the drilling operation returns through the lower telescoping spool 40, the flow controller 32, the upper telescoping spool 18 and back to the drilling rig fluid system via fluid system flow line 16 connecting with an opening 28 in the permanent housing 30. A clamp or flange 57 connects the spool 38 extending from the first outlet passage 66 to a vent line 56. Support for the fluid flow controller 32 is provided by attachment to support member 54 by structural members 55.

A blast selector/deflector 58 described in U.S. patent application Ser. No. 456,206 may advantageously be provided to deflect diverted fluids away from the drilling rig. Such U.S. patent application Ser. No. 456,206 is assigned to the same assignee as the assignee of the present application and is incorporated herewith for all purposes.

The system illustrated in FIG. 2 may advantageously be used as a diverter system during drilling through the structural casing 48 for the purpose of providing the hole for the conductor casing. According to the invention, a failsafe system is provided requiring no external valving with all the inherent advantages of simplicity, ruggedness and the ability to close about objects in the borehole or even close on open hole. The system is assured of diverting while closing the vertical flow path to the fluid system flow line in the event of a kick in the well.

Turning now to FIG. 3, an illustration of the system is presented after the conductor casing 70 has been run and cemented within the structural casing 48. Typically, the conductor casing 70 has an outside diameter of twenty (20) inches. The conductor casing is provided after the lower telescoping spool 40 has had its overshot connection removed from the structural casing 48 and has been stroked upwardly and pinned until the conductor casing 70 may be installed within the structural casing 48. After the conductor casing has been installed, the top of it is cut off and an adapter spool 71 is provided having an upwardly facing mandrel 72 which has an outside diameter equal to that of the structural casing. In other words, the mandrel 72 will typically have a nominal diameter of thirty (30) inches, similar to that of the structural casing.

After the mandrel has been installed, the lower telescoping spool may be unpinned and stroked downward until the overshot connection 50 fits about the outside diameter of mandrel 72 providing a fluid tight connection. In this configuration of FIG. 3, further drilling through the conductor casing 70 may continue in the diverter mode. In other words, the clamp or flange 57, vent line 56 and blast selector/deflector 58 may remain in place if the flow controller 32 is to be used as a diverter.

On the other hand, the flow controller 32 may be constructed to safely withstand low pressures, for example 2000 psi. Such low pressures may be contained within the conductor casing and mandrel and lower telescoping spool 40. If such a blowout preventer system is desired, the clamp or flange 57 is replaced by a clamp or flange 57A, illustrated in FIG. 3A, connecting a choke/kill line to the outlet spool 66 in the housing wall of the fluid flow controller 32. Thus, in the system which results by installing the clamp or flange 57A and choke/kill line 59, complete control over the well may be provided. In the event of a kick or high pressure condition in the well, the well may be completely controlled avoiding the necessity for diverting the high pressure fluid. The well may then be brought under control by either killing the well via tubing 59 or the tubing 59 may be used as a choke line to relieve the pressure in the well.

A second side outlet may be provided for a circulating line connection. This connection would be blinded in the divert mode and connected to the rig mud circulating equipment in the BOP mode. This alternative embodiment of the controller 32 is illustrated in FIG. 3B. The controller 32A has a first outlet passage 66 and a second outlet passage 67 with a first spool 38 and a second spool 39 extending from their respective outlet passages. In the preferred embodiment, the first spool is twelve (12) inches in diameter and the second spool is four (4) inches in diameter. The first spool is adapted for alternately connecting a blind flange or hub or choke/-kill line to the spool 38 by use of either a clamp or a flange fastening means. The second spool 39 provides means for alternately connecting a choke/kill line or a blind flange or hub to the second spool. The means may comprise either a clamp or a flange fastening means. The controller 32A could be adapted for a choke/kill line 59, as illustrated in FIG. 3A, and the second spool 39 adapted for a blind flange or, alternatively, the first spool could be provided with a blind flange and the second spool provided with a choke/kill line.

FIG. 4 illustrates the condition where the well has been drilled through the conductor casing 70 to a point where a casing string 74, typically of 13⅝ inch diameter, may be landed and cemented within the conductor casing. According to the invention, the lower telescoping spool 40 and the upper telescoping spool 18 illustrated in FIG. 3 may be disconnected from the lower and upper cylindrical openings of the fluid flow controller 32 and the fluid flow controller 32 may be stowed after moving it horizontally away from the drilling path. The upper and lower telescoping spools may then be removed through the bore of the permanent housing 30 and rotary table 12.

Next, a high pressure spool 76 may be provided through the permanent housing 30 and rotary table 12 for connection to the casing string 74. A high pressure blowout preventer stack 78 may then be connected at the drilling rig support member 54 level after which an upper telescoping spool 18 may be lowered through the rotary table 12 and permanent housing 30 and connected to the top of the high pressure blowout preventer stack 78 as previously described.

Figure 5:
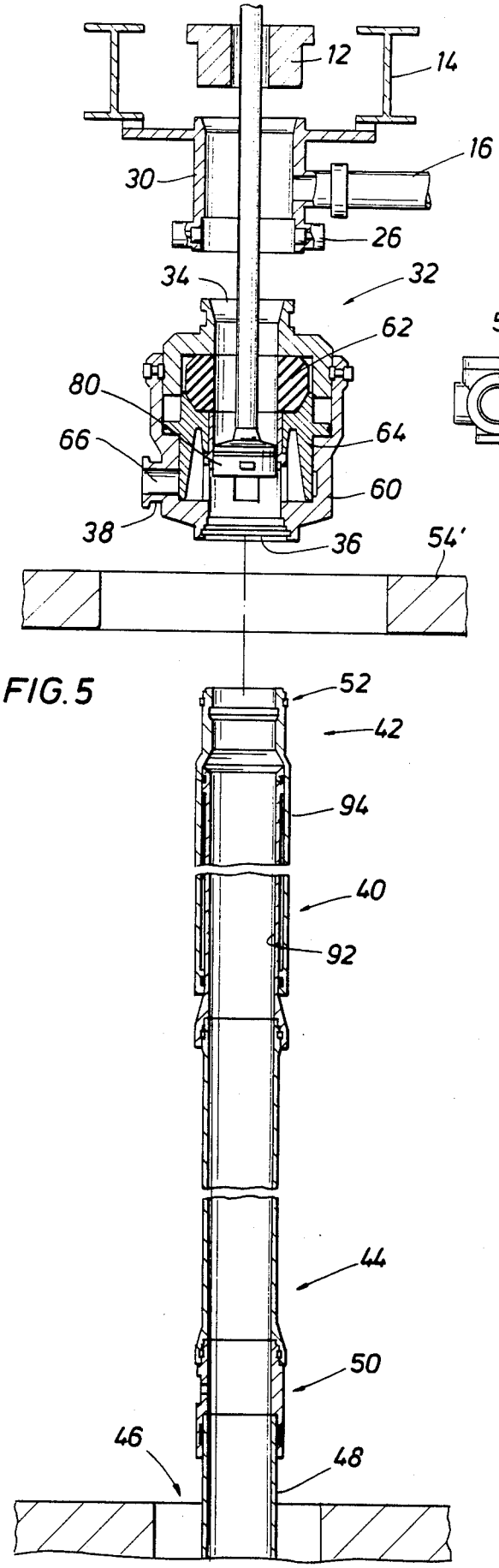
FIG. 5 illustrates the fluid flow controller and system according to the alternative embodiment of the invention at a structural level beneath the drilling rig rotary table and further illustrating the lower telescoping spool having been provided through the bore of the rotary table for connection to the fluid flow controller and to the structural casing in the borehole.

FIG. 5 illustrates an alternative embodiment of the apparatus and method for installing a fluid flow controller or diverter/BOP system 32 to the permanent housing 30. The permanent housing 30 is attached to the support beams 14 beneath the drilling rig floor. The bore of rotary table 12 is aligned with the permanent housing 30 thereby allowing tubular members to be inserted via the rotary table 12 and the permanent housing 30 to positions below. A handling tool 80 is shown inserted through the bore of the rotary table 12 and releasably secured to the fluid flow controller 32.

Figure 7:
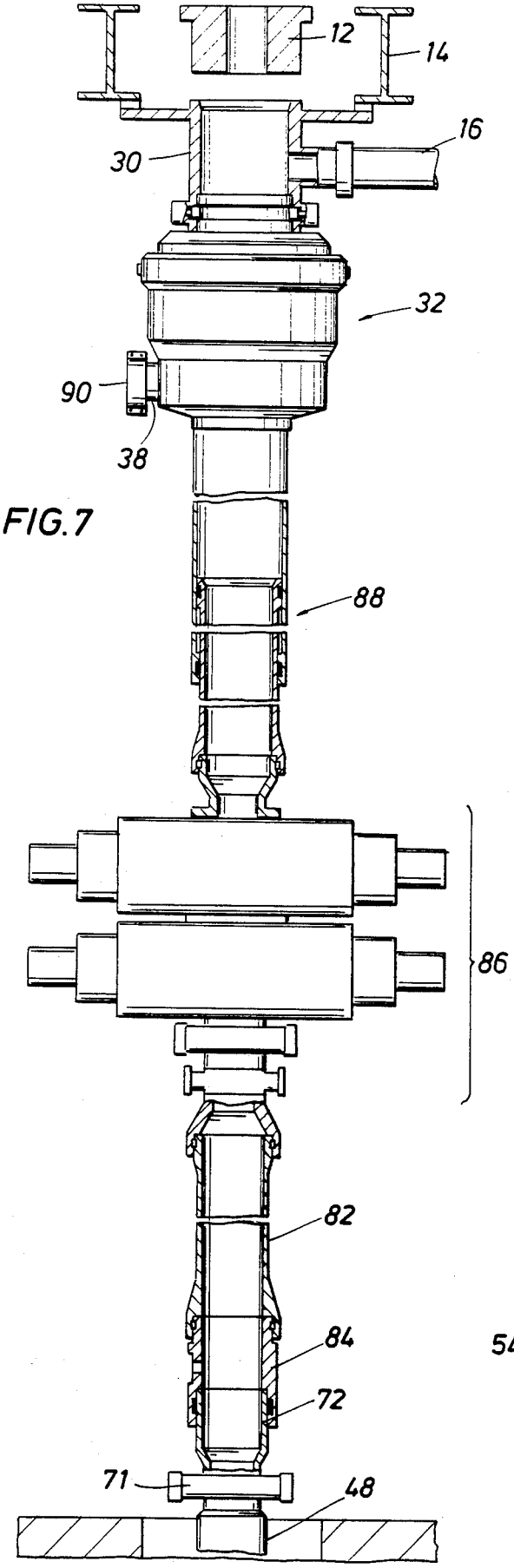
FIG. 7 illustrates the alternative embodiment of the invention after an adapter spool has been connected to the conductor casing and an adapter mandrel has been connected atop the adapter spool with a low pressure blowout preventer stack located thereon.
Figure 8:
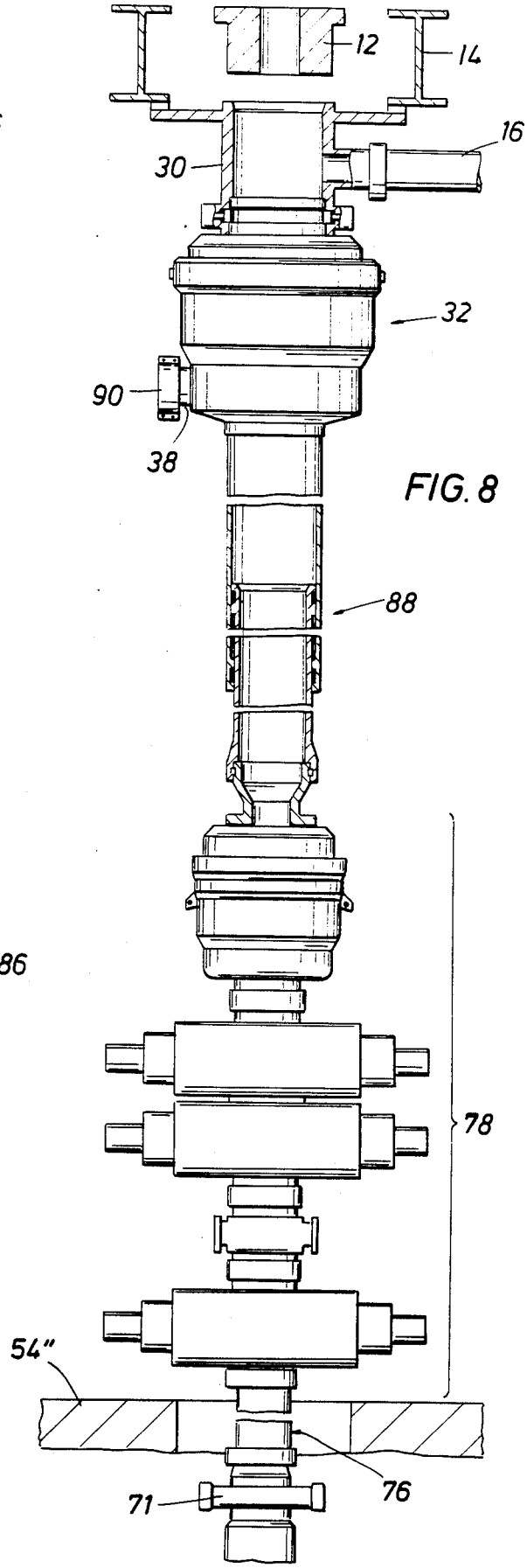
FIG. 8 illustrates the alternative embodiment of the invention after the lower telescoping spool has been removed and replaced by a high pressure spacer spool and high pressure blowout preventer stack and after a telescoping spool has been connected atop the blowout preventer stack and the fluid flow controller has been optionally reinstalled. The blowout preventer stack provides a high pressure blowout preventer system.

The fluid flow controller 32, as discussed above, has an upper cylindrical opening 34 and a lower cylindrical opening 36 and a spool 38 connected to a first outlet passage 66 in the housing wall. The fluid flow controller in FIGS. 5, 7 and 8 is identical to the fluid flow controller described in FIGS. 1, 2 3 and 4 and like numerals indicate like parts.

In FIG. 5, after the initial opening of the sea floor has been provided such as illustrated by borehole 46, a structural casing 48 is provided therein typically having a thirty (30) inch outside diameter. A lower telescoping spool 40 is lowered via the bore of the rotary table 12 through the permanent housing 30 to the proximity of the structural casing 48. The lower telescoping spool 40 has a lower barrel 92 and an upper barrel 94. The overshot sub 50 at the lower part 44 of the lower telescoping spool 40 is joined with the outer diameter of the structural casing 48 providing a lower joining means.

Preferably, during this stage of the joining of the lower telescoping spool 40 to the structural casing 48, the lower telescoping spool 40 is collapsed and pinned so that the upper part of the lower telescoping spool is not free to move with respect to the lower part 44 of the lower telescoping spool 40. Next, the fluid flow controller 32 is moved horizontally into position above the lower telescoping spool 40 and beneath the vertical bore of the permanent housing 30 and the rotary table 12.

The handling tool 80 extending through the rotary table 12 and permanent housing 30 is releasably secured within the fluid flow controller 32 and may be used to raise the flow controller 32 until the upper part of the upper cylindrical opening 34 fits within the permanent housing 30.

Figure 6:
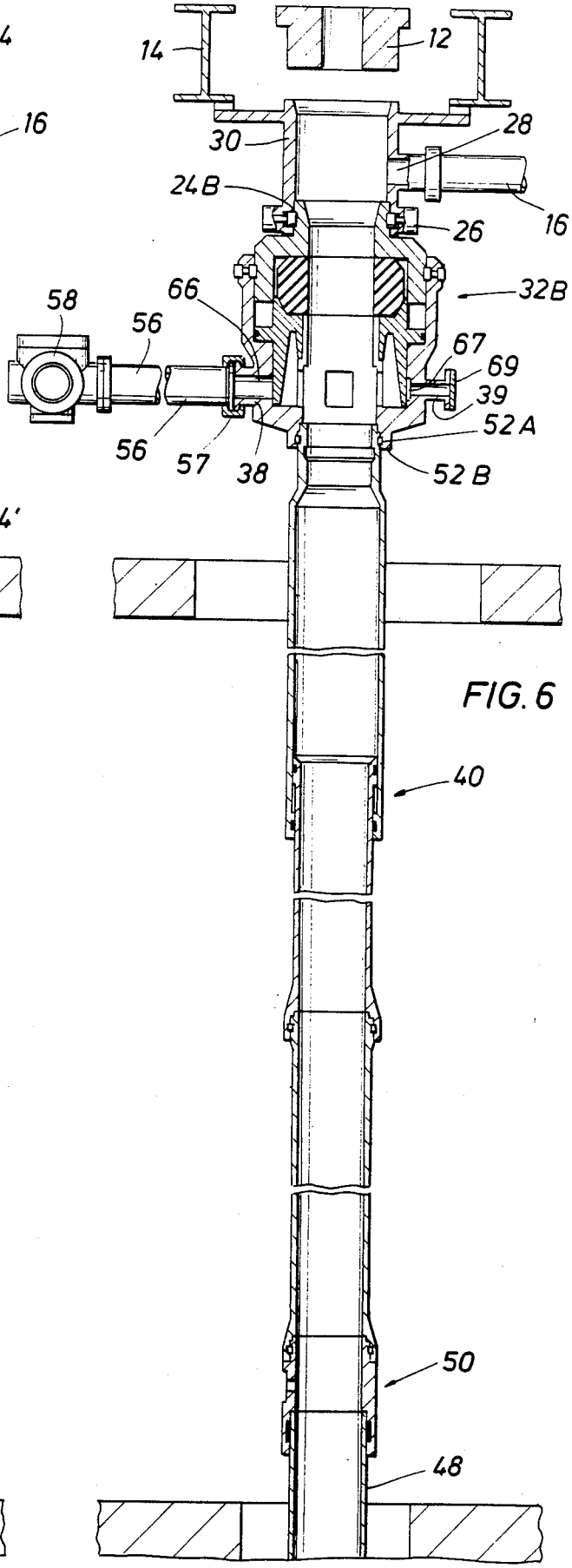
FIG. 6 shows the system according to the alternative embodiment of the invention in which the lower telescoping spool has been connected to the fluid flow controller and further illustrating a vent line connected to outlet passage in the housing wall of the fluid flow controller.

As illustrated in FIG. 6, the latching means 26 of permanent housing 30 may engage a shoulder 24B in the upper cylindrical opening 34 thereby latching the controller 32B to the permanent housing 30. A snap ring connector 52 at the top of the upper part 42 of the lower telescoping spool 40 provides a means for connecting the lower telescoping spool 40 to the lower cylindrical opening 36 of the fluid flow controller 32B. The upper part 42 of the lower telescoping spool 40 is then stroked out until the snap ring connector 52 fits within the lower cylindrical opening 36 and the snap ring 52A, illustrated in FIG. 6, snaps into an annular shoulder 52B in the lower cylindrical opening 36 thereby connecting the lower telescoping spool 40 to the fluid flow controller 32B.

In normal operation as illustrated in FIG. 6, the fluid returning from the drilling operation returns through the lower telescoping spool 40, the flow controller 32B, and back to the drilling rig fluid system through the fluid system flow line 16 connecting with an opening 28 in the permanent housing 30. A clamp or flange 57 connects the outlet spool 38 extending from the first outlet passage 66 to a vent line 56. A blast selector/deflector 58 may advantageously be provided to deflect diverted fluids away from the drilling rig.

The controller 32B is illustrated as an alternate to controller 32 with a second outlet spool 39 extending from a second outlet passage 67. In the preferred embodiment, the second spool is four (4) inches in diameter and is illustrated with a blind flange 69 fastened thereon. The cross-section of controller 32 illustrates the flow path through outlet passage 67.

The system illustrated in FIG. 6 may advantageously be used as a diverter system during drilling through the structural casing 48 for the purpose of providing the hole for the conductor casing. According to the invention, a failsafe system is provided requiring no external valving with all the inherent advantages of simplicity, ruggedness and the ability to close about objects in the borehole or even close an open hole. The system will divert upon closing the vertical flow path to the fluid system flow line 16 in the event of a kick in the well.

Turning now to FIG. 7, an illustration of the low pressure blowout preventer system is presented after the conductor casing (not shown), similar to conductor casing 70 shown in FIGS. 3 and 4, has been run and cemented within the structural casing 48. Typically, the conductor casing has an outside diameter of twenty (20) inches. The conductor casing is provided after the lower telescoping spool 40, as shown in FIGS. 5 and 6, has had its overshot sub 50 removed from the structural casing 48 and has been stroked upwardly and pinned until the conductor casing is installed within the structural casing 48. After the conductor casing has been installed, the top of the conductor casing is cut off and an adapter spool 71 and an upwardly facing mandrel 72 are installed. The mandrel 72 will typically have a nominal diameter of thirty (30) inches, similar to that of the structural casing 48.

After the mandrel 72 has been installed and the lower telescoping spool 40 has been removed, a low pressure spacer spool 82 having an overshot sub 84 fits about the outside diameter of mandrel 72 providing a fluid tight connection. A low pressure ram blowout preventer stack 86 may then be connected to the low pressure spacer spool 82 after which a telescoping spool 88 may be connected between the low pressure ram blowout preventer stack 86 and the fluid flow controller 32 or, alternatively, directly connected to the permanent housing 30. Typically, the telescoping spool 88 has an outside diameter of thirty (30) inches. Alternatively, a hard spool (not shown) could be used instead of telescoping spool 88.

When the fluid flow controller 32 is to be used as a low pressure annular blowout preventer in conjunction with the low pressure ram blowout preventer stack 86, the clamp or flange 57 connecting the vent line 56 to the spool 38 extending from the outlet passage 66 as shown in FIG. 6, may be disconnected and the vent line 56 removed so that a blind hub or flange 90 may be fastened to the spool 38 to seal off the first outlet passage 66. The flow controller 32 may then serve as an annular blowout preventer to safely withstand low pressures, for example, 2000 psi. Though not shown in FIG. 7, the blind hub or flange 90 may be removed and a choke/kill line, similar to choke/kill line 59 in FIG. 3A, may be connected to the outlet spool 38 in the housing wall of the fluid flow controller 32. In the system which results by installing the clamp 57A and the choke/kill line 59 (as illustrated in FIG. 3A), control over the well may be provided. In the event of a kick or low pressure condition in the well, the well may be controlled by circulation avoiding the necessity for diverting the high pressure fluid.

FIG. 8 illustrates the condition where the well has been drilled through the conductor casing to a point where a casing string (not shown), similar to casing string 74 in FIG. 4, typically of 13⅜ inch diameter, may be landed and cemented within the casing. According to the alternative embodiment of the invention, the lower telescoping spool 40, illustrated in FIG. 6, may be disconnected from the lower cylindrical opening of the fluid flow controller 32 and the fluid flow controller 32 may be stowed. The lower telescoping spool could then be collapsed and pinned then removed through the bore of the permanent housing 30 and the rotary table 12. Next, a high pressure spacer spool 76 may be provided for connection to the adapter spool 71. A high pressure blowout preventer stack 78, similar to the stack shown in FIG. 4, may then be connected to the high pressure spacer spool 76 after which a collapsed and pinned telescoping spool 88 may be lowered through the rotary table 12 and the permanent housing 30 and connected to the top of the high pressure blowout preventer stack 78. The telescoping spool 88 is optional and, alternatively, a hard spool (not shown) may be used. The fluid flow controller 32 may optionally be connected between the spool 88 and permanent housing 30 or the spool 88 could be connected directly to permanent housing 30.

Various modifications and alterations in the described structures will be apparent to those skilled in the art of the foregoing description which does not depart from the spirit of the invention. For this reason, these changes are desired to be included in the appended claims. The appended claims recite the only limitation of the present invention and the descriptive manner which is employed for setting forth the embodiments and is to be interpreted as illustrative and not limitative.

What is claimed is:

1. A system adapted for alternative use as a diverter or a blowout preventer for a bottom supported drilling rig and adapted for connection to a permanent housing attached to rig structural members beneath a drilling rig rotary table, the permanent housing having an outlet connectable to a rig fluid system flow line, the system comprising a fluid flow controller having a controller housing with a lower cylindrical opening and an upper cylindrical opening and a vertical path therebetween and a first outlet passage and a second outlet passage provided in its wall, a packing element disposed within the controller housing, and annular piston means adapted for moving from a first position to a second position, whereby in the first position the piston means wall prevents interior fluid from communicating with the outlet passages in the controller housing wall and in the second position the piston means wall allows fluid communication of interior fluid with the outlet passages and urges the annular packing element to close about an object extending through the bore of the controller housing or to close the vertical flow path through the controller housing in the absence of any object in the vertical flow path, means for connecting a vent line to said first outlet passage provided in the controller housing wall, a lower telescoping spool having a lower joining means at its lower end for joining alternatively to structural casing or to a mandrel connected to a conductor string cemented within the structural casing and an upper connection means at its upper end for connection to the lower cylindrical opening of the fluid flow controller, and an upper telescoping spool having a lower connection means for connection to the upper cylindrical opening of the fluid flow controller.

2. The system of claim 1 further comprising means for alternatively connecting choke/kill line to said first outlet passage.

3. The system of claim 2 further comprising means for alternatively connecting a blind flang or hub to said first outlet passage; and means for alternatively connecting a choke/kill line or a blind flange to said second outlet passage.

4. The system of claim 1 wherein the lower joining means at the lower end of the lower telescoping spool is an overshot connection.

5. The system of claim 1 wherein the upper connection means at the upper end of the lower telescoping spool is a snap joint connector.

6. The system of claim 1 wherein the lower connection means of the upper telescoping spool is a snap joint connector.

7. The system of claim 1 further comprising latching means provided on said permanent housing for connecting the upper part of the upper telescoping spool to the permanent housing.

8. The system of claim 2 wherein the means for alternatively connecting a vent line or a choke/kill line to said first outlet passage comprises a spool extending from said outlet passage, and a clamp means for connecting said spool to the vent line or alternatively to the choke/kill line.

9. The system of claim 3 wherein the means for alternatively connecting a choke/kill line or a blind flange to said second outlet passage comprises a spool extending from said second outlet passage, and a clamp means for connecting said spool to the choke/kill line or alternatively a flange fastening means for connecting said blind flange.

10. A method for installing a system adapted for alternative use as a diverter or a blowout preventer for a bottom supported drilling rig beneath a permanent housing attached to rig structural members supporting a drilling rig rotary table after structural casing has been set in a borehole, the method comprising the steps of, lowering through the rotary table a collapsed and pinned spool having a lower joining means at its lower end and an upper connector means at its upper end, joining the lower joining means at the lower end of the lower spool to the structural casing in the borehole, moving a fluid flow controller having a first housing wall outlet and a second housing wall outlet and adapted for alternative use as a diverter or a blowout preventer to a drilling rig subsupport structure beneath the rotary table and fastening the controller to the subsupport structure after the controller is substantially aligned with a bore of the rotary table above and the lower telescoping spool below, unpinning and stroking the lower telescoping spool out until the connector means at its upper end connects with the lower end of the controller, lowering through the rotary table a collapsed and pinned upper telescoping spool having a lower connector means at its lower end and connecting the upper spool to the upper end of the controller by means of its lower connector means, and unpinning and stroking the upper telescoping spool out until the upper end of the upper telescoping spool connects with the permanent housing.

11. The method of claim 10 wherein the joining means at the lower end of the lower spool is an overshot connection and the step of joining the lower joining means at the lower end of the lower spool comprises the step of sliding the overshot connector over the end of the structural casing.

12. The method of claim 10 wherein the upper connector means at the upper end of the lower spool is a snap ring connector and the step of connecting the snap ring connector of the lower spool to the lower end of the controller comprises the step of sliding the upper end of the lower spool into a lower cylindrical opening of the controller until a snap ring of the snap ring connector snaps outwardly above an annular shoulder in the lower cylindrical opening of the controller.

13. The method of claim 10 wherein the lower connector means at the lower end of the upper spool is a snap ring connector and the step of connecting the snap ring connector of the upper stool to the upper end of the controller comprises lowering the collapsed and pinned spool until its lower end slides into an upper cylindrical opening of the controller and a snap ring of the snap ring connector snaps outwardly below an annular shoulder in the upper cylindrical opening of the controller.

14. The method of claim 10 wherein the permanent housing has latching means and the step of stroking out the upper telescoping spool until it connects with the permanent housing comprises lifting the upper end of the upper spool until it engages the permanent housing and the latching means secures the upper end of the upper spool within the permanent housing.

15. The method of claim 10 further comprising the step of connecting a vent line to the first wall outlet of the controller housing and connecting a blind flange to said second wall outlet whereby the system which results may be used as diverter system for drilling the bore hole for a conductor string.

16. The method of claim 15 and after the well has been drilled for a conductor string and after the conductor string has been cemented in the well, further comprising, lifting a lower barrel of the lower telescoping spool, cutting off the conductor string, attaching a mandrel having the same outer diameter as that of the structural casing to the top of the conductor string, and lowering the lower barrel of the lower telescoping spool until the lower joining means of the lower spool joins with the mandrel, whereby the system which results may be used as a diverter during drilling through the conductor string.

17. The method of claim 16 wherein the lower joining means of the lower spool is an overshot connector and the step of lowering the lower joining means at the lower end of the lower spool comprises the step of sliding the overshot connector over the end of the mandrel.

18. The method of claim 16 further comprising the steps of, removing the vent line from the first wall outlet of the controller housing, installing a reducer to a choke/kill line, and connecting the reducer to the first wall outlet of the controller housing, whereby the system which results may be used as a blowout preventer during drilling through the conductor string.

19. The method of claim 10 wherein the method further comprises, the step of connecting a blind flange to said first wall outlet, and the step of connecting a choke/kill line to said second wall outlet.

20. The method of claim 18 and after a smaller diameter casing has been cemented into the well, disconnecting the upper telescoping spool from between the flow controller and the permanent housing, collapsing and pinning the upper telescoping spool and removing the upper telescoping spool through the rotary table, disconnecting the flow controller from the lower telescoping spool and removing the flow controller to a stowed position beneath the rig floor, collapsing and pinning the lower telescoping spool from the mandrel and removing the lower spool through the rotary table, connecting a high pressure blowout preventer spool to the smaller diameter casing, installing a high pressure blowout preventer stack into position above the high pressure spool, and lowering the upper telescoping spool through the rotary table for connection between the high pressure blowout preventer stack and the permanent housing.

21. A system adapted for alternative use as a diverter or a blowout preventer for a bottom supported drilling rig and adapted for connection to a permanent housing attached to rig structural members beneath a drilling rig rotary table, the permanent housing having an outlet connectable to a rig fluid system flow line, the system comprising a fluid flow controller having a controller housing with a lower cylindrical opening and an upper cylindrical opening and a vertical flow path therebetween and a first outlet passage provided in its wall, a packing element disposed within the controller housing, and annular piston means adapted for moving from a first position to a second position, whereby in the first position a piston means wall prevents interior fluid from communicating with the outlet passage in the controller housing wall and in the second position the piston means wall allows fluid communication of interior fluid with the outlet passage and urges the annular packing element to close about an object extending through a bore of the controller housing or to close the vertical flow path through the controller housing in the absence of any object in the vertical flow path, means for connecting a vent line to said outlet passage provided in the controller housing wall, a lower telescoping spool having a lower joining means at its lower end for joining alternatively to structural casing or to a mandrel connected to a conductor string cemented within the structural casing and an upper connection means at its upper end for connection to the lower cylindrical opening of the fluid controller, and means for connecting the upper cylindrical opening of the fluid flow controller to said permanent housing.

22. The system of claim 21 further comprising means for alternatively connecting a choke/kill line to said first outlet passage.

23. The system of claim 22 further comprising a second outlet passage in the housing wall, means for alternatively connecting a blind flange or hub to said first outlet passage, and means for alternatively connecting a choke/kill line or a blind flange to said second outlet passage.

24. The system of claim 21 wherein the lower joining means at the lower end of the lower telescoping spool is an overshot connector.

25. The system of claim 21 wherein the upper connection means at the upper end of the lower telescoping spool is a snap joint connector.

26. The system of claim 21 wherein
said connecting means is a latching means provided on said permanent housing for connecting the upper cylindrical opening of the fluid flow controller to the permanent housing.

27. The system of claim 21 wherein the means for connecting a vent line to said first outlet passage comprises
a spool extending from said outlet passage, and
a clamp means for connecting said spool to the vent line.

28. The system of claim 22 wherein the means for alternatively connecting a choke/kill line to said outlet passage comprises
a spool extending from said first outlet passage, and
a clamp means for connecting said spool to the choke/kill line.

29. The system of claim 23 wherein the means for alternatively connecting a choke/kill line or a blind flange to said second outlet passage comprises
a spool extending from said second outlet passage, and
a clamp means for connecting said spool to the choke/kill line or alternatively a flange fastening means for connecting said blind flange.

30. The system of claim 23 wherein the means for alternatively connecting a blind flange to said first outlet passage comprises
a spool extending from said outlet passage, and
a flange fastening means for connecting said spool to said blind flange.

31. A method for installing a system adapted for alternative use as a diverter or a blowout preventer for a bottom supported drilling rig beneath a permanent housing attached to rig structural members supporting a drilling rig rotary table after structural casing has been set in a borehole, the method comprising the steps of,
lowering through the rotary table a collapsed and pinned lower telescoping spool having a lower joining means at its lower end and an upper connection means at its upper end,
joining the lower joining means at the lower end of the lower spool to the structural casing in the borehole,
moving the fluid flow controller having a first housing wall outlet spool and adapted for alternative use as a diverter or a blowout preventer to a position beneath the rotary table until the controller is substantially aligned with a bore of said rotary table above and the lower telescoping spool below,
raising said fluid flow controller until an upper end of said controller is connected with said permanent housing, and
unpinning and stroking the lower telescoping spool out until the connection means at its upper end connects with a lower end of said controller.

32. The method of claim 31 wherein the lower joining means at the lower end of the lower spool is an overshot connector and the step of joining the lower joining means at the lower end of the lower spool comprises the step of sliding the overshot connector over the end of the structural casing.

33. The method of claim 31 wherein the upper connection means at the upper end of the lower spool is a snap ring connector and
the step of connecting the snap ring connector of the lower spool to a lower end of said controller comprises the step of sliding the upper end of the lower spool into a lower cylindrical opening of said controller until a snap ring of the snap ring connector snaps outwardly above an annular shoulder in the lower cylindrical opening of said controller.

34. The method of claim 31 wherein the permanent housing has a latching means and
the step of raising said fluid flow controller until it connects with the permanent housing comprises lifting an upper cylindrical opening of said controller until it engages the permanent housing and the latching means secures the upper cylindrical opening of the controller within the permanent housing.

35. The method of claim 31 further comprising the step of clamping a vent line connection to the first wall outlet spool of the controller housing whereby the system which results may be used as diverter system for drilling the bore hole for a conductor string.

36. The method of claim 35 wherein said controller further comprises
a second wall outlet, and the method further comprises,
the step of connecting a blind flange to said second wall outlet, and
alternatively connecting a choke/kill line to said first wall outlet spool.

37. The method of claim 31 wherein said controller further comprises a second wall outlet and the method further comprises,
the step of connecting a blind flange to said first wall outlet, and
the step of connecting a choke/kill line to said second wall outlet.

38. The method of claim 35 and after the well has been drilled for a conductor string and after the conductor string has been cemented in the well, further comprising,
lifting a lower barrel of the lower telescoping spool,
cutting off the conductor string,
attaching an upwardly facing mandrel having the same outer diameter as that of the structural casing to the top of the conductor string, and
lowering the lower barrel of the lower telescoping spool until the lower joining means of the lower spool joins with the mandrel,
whereby the system which results may be used as a diverter during drilling through the conductor string.

39. The method of claim 38 wherein the lower joining means of the lower spool is an overshot sub and the
step of lowering the lower joining means at the lower end of the lower spool comprises the step of sliding the overshot sub over the end of the upwardly facing mandrel.

40. The method of claim 38 further comprising the steps of,
removing the vent line from the wall outlet of the controller housing, and
installing a reducer to a choke/kill line and connecting the reducer to the wall outlet of the controller housing,
whereby the system which results may be used as a low pressure blowout preventer during drilling through the conductor string.

41. The method of claim 39 and after a smaller diameter casing has been cemented the well,
disconnecting the vent line connection to the wall outlet spool of the controller housing, installing a blind flange to said wall outlet spool of said flow controller, disconnecting said fluid flow controller from the lower telescoping spool and removing the flow controller to a stowed position beneath the rig floor, collapsing and pinning the lower telescoping spool and removing the lower spool through the rotary table, installing a low pressure spacer spool having an overshot sub at its lower end to said mandrel, installing a low pressure blowout preventer stack to said low pressure spacer spool, installing a second spool above the low pressure blowout preventer stack, and connecting said second spool to said permanent housing.

42. The method of claim 41 further comprising the steps of disconnecting said blind flange from said wall outlet spool, and installing a choke/kill line to said wall outlet spool.

43. The method of claim 41 wherein said second spool is a telescoping spool.

44. The method of claim 41 wherein said second spool is a hard spool.

45. The method of claim and after a smaller diameter casing has been cemented into the well, disconnecting said fluid flow controller from the lower telescoping spool and said permanent housing and removing the flow controller to a stowed position beneath the rig floor, installing a blind flange to said wall outlet spool of said flow controller after removing said vent line from the outlet spool, collapsing and pinning the lower telescoping spool and removing the lower spool through the rotary table, connecting a high pressure blowout preventer spacer spool to the smaller diameter casing, installing a high pressure blowout preventer stack above the high pressure blowout preventer spacer spool, connecting a second spool to the top of the high pressure blowout preventer stack, and connecting said second spool to said permanent housing

46. The method of claim 45 further comprising the step of disconnecting said blind flange from said wall outlet spool, and installing a choke/kill line to said wall outlet spool.

47. The method of claim 45 wherein said second spool is a telescoping spool.

48. The method of claim 45 wherein said second spool is a hard spool.

* * * * *